US005397289A

United States Patent [19]

Entz et al.

[11] Patent Number: 5,397,289

[45] Date of Patent: Mar. 14, 1995

[54] GIMBALLED ROLLER FOR WEB MATERIAL

[75] Inventors: Steven F. Entz, Albion; Randy E. Horning, Leroy; Yonathan Preiss, Penfield; Ronald W. Grant, Caledonia, all of N.Y.

[73] Assignee: Eastman Kodak Company, Rochester, N.Y.

[21] Appl. No.: 128,395

[22] Filed: Sep. 28, 1993

[51] Int. Cl.[6] ..... B23P 15/00

[52] U.S. Cl. ..... 492/17; 492/24; 492/25; 492/39; 492/47

[58] Field of Search ..... 492/22, 24, 25, 26, 492/20, 17, 39, 40, 47; 226/180, 181, 179, 190, 189

[56] References Cited

U.S. PATENT DOCUMENTS

| | | | |
|---|---|---|---|
| 1,566,441 | 12/1925 | Smothers . | |
| 2,262,325 | 11/1941 | Kendall | 226/190 |
| 2,273,565 | 2/1942 | Euth et al. | 197/142 |
| 2,924,002 | 2/1960 | Ibbs | 28/55 |
| 2,979,829 | 4/1961 | Uhleen | 34/90 |
| 3,095,131 | 6/1963 | Robertson et al. | 226/190 |
| 3,163,343 | 12/1964 | Zernov | 226/199 |
| 3,731,571 | 5/1973 | Larson | 83/420 |
| 3,752,377 | 8/1973 | Knapp | 226/3 |
| 4,037,769 | 7/1977 | Meyers | 226/190 |
| 4,227,636 | 10/1980 | Rahmfeld et al. | 226/189 |
| 4,350,277 | 9/1982 | Anderson et al. | 226/190 |
| 4,552,295 | 11/1985 | Smith et al. | 226/190 |
| 4,625,902 | 12/1986 | Billberg | 226/190 |
| 4,785,514 | 11/1988 | Kannwischer | 29/116.1 |
| 4,829,645 | 5/1989 | Kannwischer | 29/123 |
| 4,863,085 | 9/1989 | Takenouchi et al. | 226/190 |
| 5,011,060 | 4/1991 | Cramer | 226/190 |
| 5,074,450 | 12/1991 | Lindner et al. | 226/189 |
| 5,087,318 | 2/1992 | Anderson | 156/540 |

*Primary Examiner*—Irene Cuda
*Attorney, Agent, or Firm*—Edward Dugas

[57] ABSTRACT

A gimballed roller automatically positions itself with regards to a moving web of material to minimize misalignment forces on the web material and additionally incorporates a feature of being quickly adjusted by an operator to accommodate different widths of web material.

5 Claims, 2 Drawing Sheets

GIMBALLED ROLLER FOR WEB MATERIAL

FIELD OF THE INVENTION

The present invention relates to the field of providing a rolling surface for a web material and more particularly to rollers that guide a web without inducing an angular constraint for various web widths.

BACKGROUND OF THE INVENTION

Machines which process long strips and/or rolls of web material such as photographic film or paper are provided with the capability of handling different widths of the film in order to take advantage of the high costs associated with each machine. The prior art utilizes rollers and guides that are manually adjusted prior to the insertion of the film web or strip. After the insertion, it becomes apparent that perfect alignment of the film web is not maintained due to misalignments of the rollers and/or variations in the thickness and/or widths of the web of film material. Those misalignments, when detected, are compensated for by re-adjusting mechanically the axes of the rollers until the desired alignment is achieved.

PROBLEM TO BE SOLVED BY THE INVENTION

The present invention is directed to the combination of gimballed rollers and adjustable, laterally constraining, pivoting edge guides to accommodate for variations in the width of a web material and in misalignments of the rollers with respect to the surface of the web material so as to reduce friction and to eliminate emulsion side damage when the web material is a photographic film.

SUMMARY OF THE INVENTION

In one preferred embodiment of the invention there is provided a gimballed roller for web material comprising:

- a shaft;
- at least one pair of rollers positioned on said shaft for rotation on said shaft; and
- means for gimballing said shaft about a central position between said at least one pair of rollers.

In another embodiment of the invention there is provided a gimballed roller for web material comprising:

- a hollow shaft having a longitudinal slot along each of its outermost ends;
- at least one pair of rollers positioned on said hollow shaft for rotation on said hollow shaft;
- means for gimballing said hollow shaft about a central position between said at least one pair of rollers;
- a cam shaft having a pair of counter-rotating spiraled groves along each of its outermost ends and positioned for rotation within the hollow of said hollow shaft; and
- edge guide means movably positioned on the outermost ends of said hollow shaft each having a projection extending through a corresponding longitudinal slot in said hollow shaft and into a sliding contact with the spiraled groves in said cam shaft such that rotation of said cam shaft causes said edge guide means to move along said hollow shaft.

The roller system of the present invention will be seen to provide a gimballing arrangement that allows the rollers to assume a position dictated by the alignment of the web material. In addition, the rollers are provided with a degree of freedom along the axis of rotation of the rollers to take away any angular constraint on the web. The positioning of pivoting edge guides is a function of the width of the web paper to be processed over the rollers and is adjusted by a single knob that is easily accessible to an operator at the end of the rollers' shaft.

From the foregoing it can be seen that it is a primary object of the present invention to provide an improved roller arrangement that incorporates a gimbal.

It is another object of the present invention to provide a gimballed roller arrangement that is easily adjustable to accommodate different widths of webbed material.

These and other objects of the present invention will become more apparent when taken in conjunction with the following description and drawings wherein like characters indicate like parts and which drawings form a part of the present invention.

DETAILED DESCRIPTION OF THE INVENTION

Figure 1:
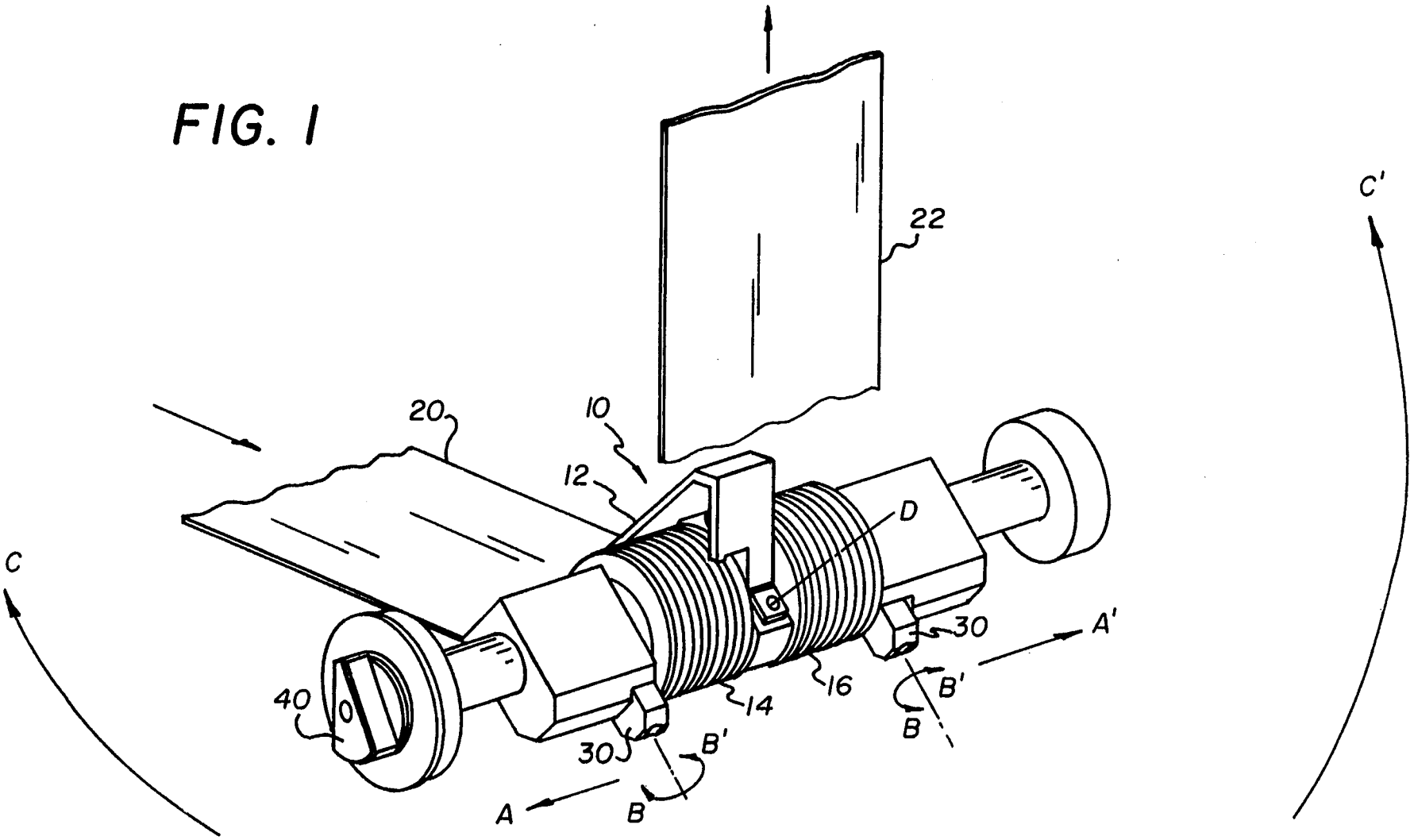
FIG. 1 is a perspective view of the present invention illustrating the flow of the webbed material over the rollers and the movement of the gimballed rollers in response thereto indicated by action arrows.
Figure 2:
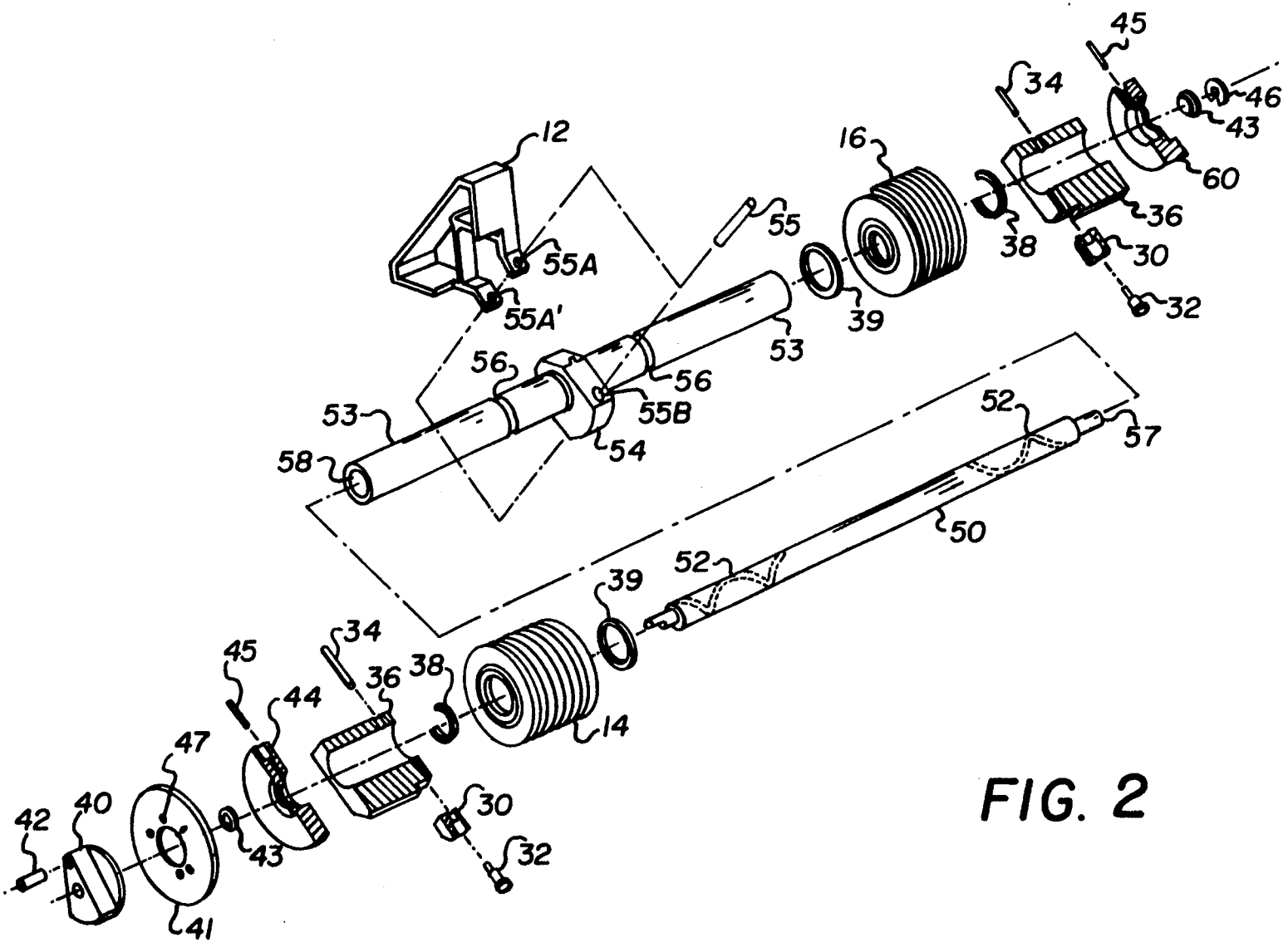
FIG. 2 is an exploded diagram illustrating the component parts of the gimballed roller system of the present invention.

Referring to FIG. 1, the gimballed roller assembly 10 is shown comprised in part of a mounting bracket 12 to which is rotatably affixed, by means shown in more detail in FIG. 2, a pair of roller elements 14 and 16. The outer portion of the gimballed roller incorporates edge guides 30 which are moved into alignment position to the edges 22 of a paper web 20. The width of the spacing between the guides 30 is controlled by a knob 40 which, when rotated, moves the edge guides 30 either inwards or outwards along the indicated arrowed-action line labeled A and A'. The edge guides 30 are free to pivot to take up a position somewhere along the edge path of the paper 20, generally indicated by the action-arrowed lines B and B'. Dependent on the positioning of the paper with regards to the central axis along which the rollers rotate, the roller assembly is free to pivot about the pivot point indicated by the line labeled D in the directions shown by the action arrows C and C'.

In operation then, the gimballed roller assembly 10 shown in FIG. 1 is placed into operation by rotating the adjustment knob 40 to provide a width between the edge guides 30 that is wider than the edges 22 of the paper 20. The knob 40 may then be rotated so as to bring the edge guides 30 into slight contact with or into an abutting position with regards to the edges 22. As the paper is tensioned over the rollers 14 and 16 they will cause a rotation about the axis D that will balance the forces appearing on each of the rollers to compensate for any misalignments of the paper 20.

Referring now to FIG. 2 for a detailed view of the parts of the gimballed roller assembly 10, the mounting (gimbal) bracket 12 is shown with openings 55A and 55A'. These openings are designed to align with an opening 55B formed in a gimbal block 54 such that a gimbal pin 55 passing through 55A and 55A' will mount the gimbal block to the mounting bracket 12. Affixed to the gimbal block 54 is a hollow tube section (shaft) 53. A cam shaft 50 having a pair of counter-rotating spiraled groves 52 along each of its outermost ends is positioned within the hollow of shaft 53. Spacers 39 are positioned onto shaft 53 abutting the surface of the gimbal block 54. Positioned next onto the shaft 53 are compliant rollers 14 and 16 having intregal ball bearing assemblies to facilitate rotation. The compliant rollers are held in position on the shaft 53 by C-type snap rings 38 engaging groves 56. A pair of sliding blocks 36 are next positioned onto opposite ends of the shaft 53 with a guide pin 34 projecting through to the inner bearing surface of the sliding block and through a longitudinal slot 58 formed in the hollow shaft 53 so as to engage the grove 52 that is formed in the cam 50. Rotation of the cam 50 about its elongated axis will thus cause the sliding blocks 36 to move in and out (i.e., along the axis of the shaft 53). Edge guides 30 are pivotedly affixed to the sliding block 36 by means of pivot pins 32. An endcapped mounting disk 44, with bushing 43 previously installed, is affixed to the end of the shaft 53 by two set screws (not shown) and a locating anti-pinch pin 45 projecting into slot 58 in the end of the shaft 53. Likewise an endcap 60, with bushing 43 previously installed, is affixed to the other end of the shaft 53 in a similar manner. The endcap 60 has a designed weight so as to balance the entire assembly around the axis of the gimbal pin 55. Cam shaft 50 is retained between 44 and 60 with a keeper ring 46 being forced into the grove 57 on one end and by a detent disk 41 and a detent knob 40 being attached to the opposite end of the cam 50. The detent disk 41 is fixed in relationship to the endcap mounting disk 44 which in turn fixes the detent disk in a nonmovable relationship with regards to the shaft 53. The detent knob 40, being affixed to the cam 50, is rotatable, which rotation in turn, causes the cam 50 to rotate. As previously discussed, this knob moves the sliding blocks 36 inwards and/or outwards dependent upon the rotational direction and the amount of rotation of the detent knob 40. A plunger 42 is slideably affixed to the detent knob to engage a selected opening 47 in the detent disk 41 at each of a multiple of indicated width positions.

While there has been shown what is considered to be the preferred embodiment of the invention, it will be manifest that many changes and modifications may be made therein without departing from the essential spirit of the invention. It is intended, therefore, in the annexed claims, to cover all such changes and modifications as may fall within the true scope of the invention.

| Parts List: | |
|---|---|
| 10 | Gimballed roller assembly |
| 12 | Mounting (gimbal) bracket |
| 14 | Roller |
| 16 | Roller |
| 20 | Paper |
| 22 | Edges |
| 30 | Pivoting Edge guides |
| 32 | Pivot pins |
| 34 | Guide pin |
| 36 | Sliding blocks |
| 38 | "Type" snap rings |
| 39 | Spacers |

-continued

| Parts List: | |
|---|---|
| 40 | Detent knob |
| 41 | Detent disk |
| 42 | Plunger |
| 43 | Bushing |
| 44 | Endcap mounting Disk |
| 45 | Locating/anti-pinch pin |
| 46 | Keeper ring |
| 47 | Opening |
| 50 | Cam shaft |
| 52 | Spiraled groves |
| 53 | Shaft |
| 54 | Gimbal block |
| 55 | Gimbal pin |
| 55A | Opening |
| 55A' | Opening |
| 55B | Opening |
| 56 | Groves |
| 57 | Grove |
| 58 | Slot |
| 60 | Endcap |

We claim:

1. A gimballed roller for web material comprising:

a hollow shaft having a longitudinal slot along each of its outermost ends;

at least one pair of rollers positioned on said hollow shaft for rotation on said hollow shaft;

means for gimballing said hollow shaft about a central position between said at least one pair of rollers;

a cam shaft having a pair of counter-rotating spiraled groves along each of its outermost ends and positioned for rotation within the hollow of said hollow shaft; and edge guide means movably positioned on the outermost ends of said hollow shaft each having a projection extending through a corresponding longitudinal slot in said hollow shaft and into a sliding contact with the spiraled groves in said cam shaft such that rotation of said cam shaft causes said edge guide means to move along said hollow shaft.

2. The gimballed roller according to claim 1 wherein said edge guide means includes pivoting edge guides.

3. The gimballed roller according to claim 1 and further comprising, detent means affixed to said cam for providing an indication that the cam has positioned the edge guide means at positions for guiding at least one width of web material.

4. The gimballed roller according to claim 1 wherein said edge guide means are comprised of:

a pair of sliding blocks each positioned for sliding on an associated outer end of said hollow shaft;

each sliding block having a pin member projecting from said sliding block through the longitudinal slot in said hollow shaft into the spiral grove at its associated end of said cam shaft; and a pair of pivoting edge guides, one each connected to a respective sliding block.

5. A gimballed roller for web material comprising:

a shaft;

at least one pair of rollers positioned on said shaft for rotation on said shaft;

means for gimballing said shaft about a central position between said at least one pair of rollers; and adjustable guide means movably positioned on said shaft for guiding web material over said at least one pair of rollers, said adjustable guide means includes pivoting edge guides.

* * * * *